US010557183B2

(12) United States Patent
Lee et al.

(10) Patent No.: US 10,557,183 B2
(45) Date of Patent: Feb. 11, 2020

(54) WORK HARDENABLE YIELD RATIO-CONTROLLED STEEL AND METHOD OF MANUFACTURING THE SAME

(71) Applicant: Korea Institute of Machinery and Materials, Daejeon (KR)

(72) Inventors: Youngseon Lee, Gyeongsangnam-do (KR); Chang Gil Lee, Gyeongsangnam-do (KR)

(73) Assignee: KOREA INSTITUTE OF MACHINERY AND MATERIALS, Daejeon (KR)

( * ) Notice: Subject to any disclaimer, the term of this patent is extended or adjusted under 35 U.S.C. 154(b) by 137 days.

(21) Appl. No.: 14/811,223

(22) Filed: Jul. 28, 2015

(65) Prior Publication Data

US 2016/0032417 A1 Feb. 4, 2016

(30) Foreign Application Priority Data

Jul. 29, 2014 (KR) ..... 10-2014-0096321

(51) Int. Cl.

| | |
|---|---|
| ***C21D 9/08*** | (2006.01) |
| ***C22C 38/06*** | (2006.01) |
| ***C22C 38/04*** | (2006.01) |
| ***C22C 38/02*** | (2006.01) |
| ***C21D 6/00*** | (2006.01) |
| ***C21D 8/06*** | (2006.01) |

(52) U.S. Cl.

CPC ..... *C21D 9/08* (2013.01); *C21D 6/005* (2013.01); *C21D 6/008* (2013.01); *C21D 8/065* (2013.01); *C22C 38/02* (2013.01); *C22C 38/04* (2013.01); *C22C 38/06* (2013.01)

(58) Field of Classification Search

CPC ..... C21D 9/08; C21D 6/008; C21D 8/065; C22C 38/06; C22C 38/04; C22C 38/02

See application file for complete search history.

(56) References Cited

U.S. PATENT DOCUMENTS 3,359,094 A * 12/1967 Bieber ..... C22C 38/105 148/328
4,406,713 A * 9/1983 Yutori ..... C21D 8/00 148/328

(Continued)

FOREIGN PATENT DOCUMENTS

KR 10-2009-0057564 A 6/2009

*Primary Examiner* — Veronica F Faison
(74) *Attorney, Agent, or Firm* — Dentons US LLP

(57) ABSTRACT

A method of manufacturing yield ratio-controlled steel, including the steps of subjecting alloy steel to rolling or wire drawing, thus obtaining a bar material; performing a first heat treatment, in which the material is heated and maintained for a predetermined period of time at a first temperature ranging from $A_{c1}$ to $A_{c3}$ based on $A_{c1}$ and $A_{c3}$ transformation temperatures; and cooling the material to a second temperature ranging from Mf to Ms based on a martensite start temperature (Ms) and a martensite finish temperature (Mf), and performing a second heat treatment, in which the material is maintained at the second temperature for a predetermined period of time.

11 Claims, 20 Drawing Sheets

(56) References Cited

U.S. PATENT DOCUMENTS

| | | | | |
|---|---|---|---|---|
| 4,770,719 | A * | 9/1988 | Hashiguchi | C21D 1/185<br>148/504 |
| 5,213,634 | A * | 5/1993 | DeArdo | C22C 38/22<br>148/334 |
| 5,601,667 | A * | 2/1997 | Takahashi | C21D 7/13<br>148/649 |
| 6,419,761 | B1 * | 7/2002 | Hashimura | C22C 38/02<br>148/320 |
| 2002/0007882 | A1 * | 1/2002 | Inoue | C21D 8/0226<br>148/541 |
| 2002/0040744 | A1 * | 4/2002 | Kanisawa | C21D 8/06<br>148/320 |
| 2003/0075250 | A1 * | 4/2003 | Ochi | C21D 1/32<br>148/654 |
| 2004/0226635 | A1 * | 11/2004 | Ikeda | C21D 7/13<br>148/649 |
| 2008/0247900 | A1 * | 10/2008 | Hayashi | C21D 1/10<br>420/84 |
| 2008/0264524 | A1 * | 10/2008 | Maruta | C21D 1/10<br>148/330 |
| 2013/0174947 | A1 | 7/2013 | Lee et al. | |
| 2014/0230969 | A1 * | 8/2014 | Sugimoto | C22C 38/38<br>148/330 |

* cited by examiner

| Specimen | Yield strength (Mpa) | Tensile strength (Mpa) | Yield ratio (Y.R.) | Elongation(%) |
|---|---|---|---|---|
| ① | 393.7 | 762.7 | 0.516 | 32.1 |
| ② | 441.0 | 734.1 | 0.600 | 36.9 |

| [illegible] | [illegible] |
|---|---|
| 0 | 9 |
| 0.1 | 19 |
| 0.15 | 24 |
| 0.2 | 25 |
| 0.3 | 25 |
| 0.4 | 27 |
| 0.45 | 28 |
| 0.5 | 28 |
| 0.6 | 29 |
| 0.7 | 29 |
| 0.7 | 29 |
| 0.8 | 30 |
| 0.85 | 31 |
| 0.9 | 31 |
| 1.2 | 31 |
| 1.3 | 34 |
| 1.4 | 34 |
| 1.5 | 34 |

1045K

Heat treatment (1045K)

YRCS80

Hardness of Rockwell (HRC) Required hardness : HRC 25~30

| | 1045K | | Heat treatment | | YRCS80 | |
|---|---|---|---|---|---|---|
| Head | 22 | 23 | 25 | 25 | 27 | 29 |
| Middle | 15 | 19 | 25 | 25 | 26 | 25 |
| Screw | 15 | 14 | 26 | 26 | 25 | 25 |

YRCS100 [Forging]

SCM435 [Forging]

SCM435 [Forging and Heat Treatment (Q/T)]

| Hardness(HRC) | 1 | 2 | 3 | 4 | 5 | 6 | 7 | 8 |
|---|---|---|---|---|---|---|---|---|
| YRCS100[Forging] | 37 | 37 | 36 | 37 | 37 | 38 | 36 | 35 |
| SCM435[Forging] | 26 | 26 | 24 | 26 | 27 | 30 | 27 | 21 |
| SCM435[Forging and Heat Treatment (Q/T)] | 35 | 35 | 35 | 35 | 35 | 35 | 35 | 34 |

WORK HARDENABLE YIELD RATIO-CONTROLLED STEEL AND METHOD OF MANUFACTURING THE SAME

CROSS-REFERENCE TO RELATED APPLICATION

This application claims priority to Korean Patent Application No. 10-2014-0096321 filed on Jul. 29, 2014 and all the benefits accruing therefrom under 35 U.S.C. § 119, the contents of which are incorporated by reference in their entirety.

BACKGROUND OF THE INVENTION

1. Field of the Invention

The present invention relates to a steel material and a method of manufacturing the same, wherein the yield ratio of the steel material is controlled, whereby the steel material having the same tensile strength may easily undergo metal working such as plastic working, cutting, etc., and whereby the manufacturing cost thereof may also be decreased.

2. Description of the Related Art

In the manufacture of parts using steel-forged products, many attempts have been made to reduce manufacturing costs through process improvements and automation, among which the elimination of quenching and tempering (which is hereinafter referred to as "Q/T") after forging is essential in order to save energy and improve process efficiency (in automation lines).

FIG. 1 is a flowchart illustrating the conventional process of manufacturing typical quenched and tempered steel using Q/T after forging.

As illustrated in FIG. 1, the quenched and tempered steel is manufactured in such a manner that spheroidizing is performed for 10 hr or longer to reduce hardness and forging load, cold forging is conducted, and then post heat treatment, namely, Q/T, is essentially carried out to ensure mechanical properties after the forging.

Due to pre/post heat treatment and the large number of processes involved, the manufacturing cost is excessively increased, and a correction process is additionally required owing to dimensional changes attributable to heat treatment deformation, undesirably negating the energy saving and automation benefits.

Hence, thorough research is ongoing into the development of a forging process and Non-Heat-Treated steel without the need for Q/T after the forging. Domestically, hot forged products are mainly applied to parts that do not require toughness, such as crankshafts, wheel hubs, etc., and Non-Heat-Treated steel products for hot forging are being developed and employed in knuckles and connecting rods for vehicles.

Also, Non-Heat-Treated steel for cold forging has been developed, and the application thereof has been attempted, but some examples (LH85, etc.) thereof are limitedly applied to bolts. Although this steel is advantageous because it obviates the need for Q/T after forging, the forging load may be excessively raised at a tensile strength of 80 kgf/$mm^2$ or more, attributable to the high yield ratio thereof, undesirably shortening the lifetime of a mold, thereby making it impossible to broaden the scope of application thereof.

Furthermore, steel wires resulting from the continuous production of cold Non-Heat-Treated steel comprising a two-phase structure of ferrite and pearlite are problematic in terms of non-uniform quality because there is a significant material difference of 20% or more between the head portion and the tail portion. In order to solve this problem, as illustrated in FIG. 2, isothermal transformation has to be additionally carried out before cold forging, which may increase material costs, making it difficult to apply.

SUMMARY OF THE INVENTION

Accordingly, the present invention has been made keeping in mind the above problems encountered in the related art, and an object of the present invention is to provide a steel material and a method of manufacturing the same, wherein post heat treatment may be obviated, manufacturing costs may be considerably reduced through simple pretreatment, and a low yield ratio may result, thereby increasing moldability and workability and lowering the forging load.

Another object of the present invention is to provide a steel material and a method of manufacturing the same, wherein the yield ratio thereof may be lowered, thus increasing the lifetime of a mold and facilitating the development of high-strength parts, thereby enabling the easy formation of cold forged products (bolts, shafts, bars, rods, studs, etc.) having not only 8T but also 10T or higher grades.

The present invention provides a method of manufacturing yield ratio-controlled steel, comprising subjecting alloy steel, comprising 0.10 to 0.40 wt % carbon (C), 0.90 to 1.50 wt % manganese (Mn), 0.50 to 2.50 wt % silicon (Si), and 0.060 wt % or less but exceeding 0 wt % aluminum (Al), with the remainder of iron (Fe) and unavoidable impurities, to rolling or wire drawing, thus obtaining a bar material having a desired size, followed by two-stage continuous heat treatment for yield ratio control, resulting in a material having a desired yield ratio.

As used herein, the term "two-stage continuous heat treatment for yield ratio control" refers to a process comprising first heat treatment, in which the material is heated and maintained for a predetermined period of time at a first temperature ranging from $A_{c1}$ to $A_{c3}$ based on $A_{c1}$ and $A_{c3}$ transformation temperatures, cooling to a second temperature ranging from Mf to Ms based on a martensite start temperature (Ms) and a martensite finish temperature (Mf), and second heat treatment, in which the material is maintained at the second temperature for a predetermined period of time.

In addition, the present invention provides yield ratio-controlled steel, manufactured by the above method. The yield ratio-controlled steel resulting from the above two-stage heat treatment has a structure configured to include a ferrite base structure and bainite (or martensite), and exhibits various yield ratios depending on the structure distribution thereof, and can thus be manufactured into desired materials by the use of an appropriate type of metal working.

In addition, the present invention provides a method of manufacturing a cold forged part, comprising subjecting alloy steel, comprising 0.10 to 0.40 wt % carbon (C), 0.90 to 1.50 wt % manganese (Mn), 0.50 to 2.50 wt % silicon (Si), and 0.060 wt % or less but exceeding 0 wt % aluminum (Al), with the remainder of iron (Fe) and unavoidable impurities, to rolling or wire drawing, thus obtaining a material; performing first heat treatment, in which the material is heated and maintained for a predetermined period of time at a first temperature ranging from $A_{c1}$ to $A_{c3}$ based on $A_{c1}$ and $A_{c3}$ transformation temperatures; cooling the material to a second temperature ranging from Mf to Ms based on a martensite start temperature (Ms) and a martensite finish temperature (Mf), and performing second heat treatment, in which the material is maintained at the second temperature for a predetermined period of time; and subjecting the material to cold forging.

According to the present invention, a method of manufacturing yield ratio-controlled steel enables the alloy steel to be heat-treated to control the structure thereof, thereby obtaining low-yield-ratio steel. The low-yield-ratio steel can be utilized as a material for cold forging at room temperature. When the yield strength is low, plastic deformation is easily carried out, and additionally, high tensile strength can be attained using work hardenability that is controlled as necessary. Hence, it is possible to obtain products having desired strength even without the use of Q/T after forging.

Furthermore, post heat treatment can be obviated, the manufacturing costs can be remarkably decreased through simple pretreatment, moldability and workability can be improved, and the forging load can be decreased.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SPECIFIC EMBODIMENTS

Figure 1:
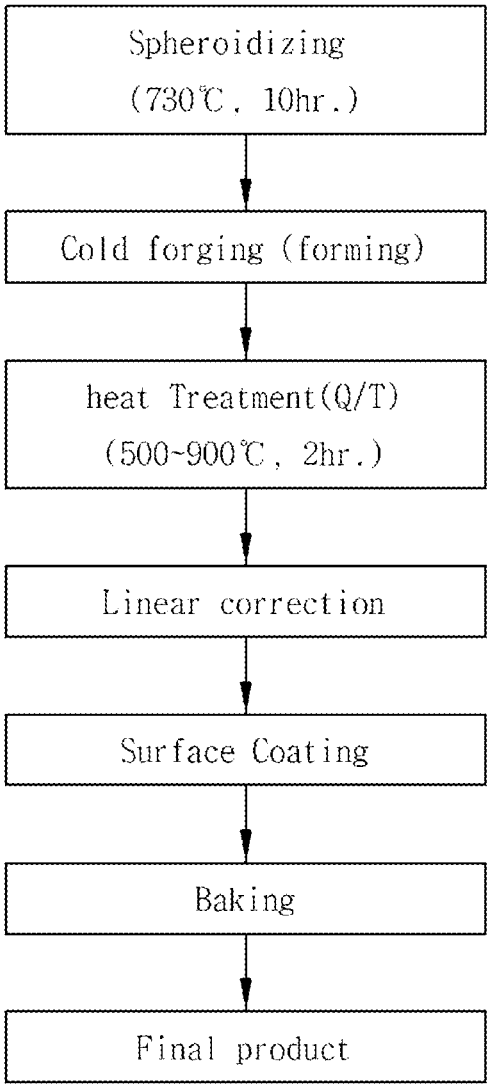
FIG. 1 is a flowchart illustrating a conventional process of manufacturing a forged product from typical quenched and tempered steel.

Hereinafter, a detailed description will be given of embodiments of the present invention with reference to the appended drawings. Throughout the drawings, the same constituents or parts are referred to using the same reference numerals. Also, detailed descriptions of related known technology that may unnecessarily obscure the gist of the present invention will be omitted.

Representative steel wires for cold forging are useful in various bolts, as shown in Table 1 below.

TABLE 1

| Classification | Steel species | End uses |
|---|---|---|
| C steel | SWRCH-SK, SWRCH-AK | Bolts, nuts, screws |
| B steel | AISI10B35, AISI51B20 | Shafts for safety belts, bolts for vehicles, bolts for construction |
| Cr—Mo steel | SCM435, SCM415H | Various bolts, retainers, piston pins |
| Mo steel | AISI4037 | Bolts for vehicles |
| Ni—Cr—Mo steel | SAE8620H, AISI8740H | Gears for oil pumps, bolts for aircraft |

Figure 2:
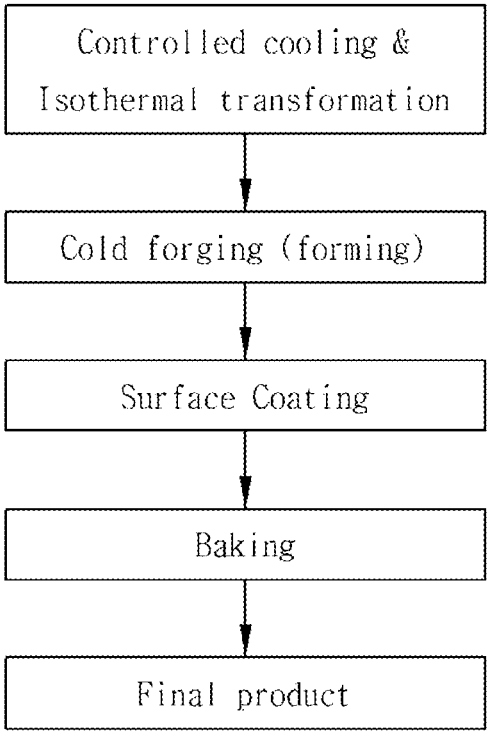
FIG. 2 is a flowchart illustrating a conventional process of manufacturing a forged product from typical cold Non-Heat-Treated steel.

As is apparent from Table 1, steel wires for cold forging are employed in various bolts and are produced by a variety of manufacturers. They are produced by the methods of manufacturing quenched and tempered steel and Non-Heat-Treated steel as shown in FIGS. 1 and 2, and thus limitations are imposed on the production costs or performance of products.

Below is a description of a method of manufacturing yield ratio-controlled steel according to the present invention, wherein in the manufacture of steel wires for cold forging, the yield ratio of the steel material is controlled, whereby the steel material having the same tensile strength may be easily worked depending on the type of metal working, and the manufacturing cost thereof may be reduced.

Figure 3:
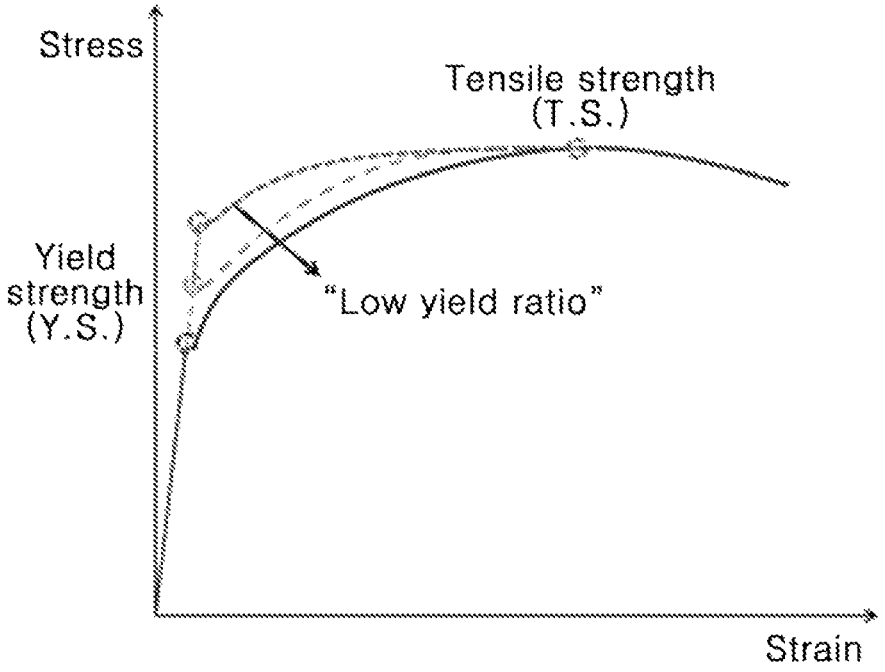
FIG. 3 is a graph illustrating the yield ratio.

As used herein, the term "yield ratio" refers to a ratio of yield strength/tensile strength (Y.S./T.S.), and FIG. 3 illustrates the graph of the yield ratio.

As illustrated in FIG. 3, the material for plastic working, as manufactured by the method of manufacturing yield ratio-controlled steel according to the present invention, is controlled to have a low yield ratio, and may thus be deformed at low load, thereby decreasing the forging load and increasing the lifetime of the mold, ultimately reducing the manufacturing cost. Furthermore, the material for cutting is controlled to have high yield ratio, thereby ensuring superior cuttability even when using a raw material not subjected to Q/T.

In the method of manufacturing yield ratio-controlled steel according to the present invention, alloy steel, comprising 0.10 to 0.40 wt % C, 0.90 to 1.50 wt % Mn, 0.50 to 2.50 wt % Si, and 0.060 wt % or less but exceeding 0 wt % Al, with the remainder of Fe and unavoidable impurities, is subjected to rolling or wire drawing, thus forming a bar material. The use of the alloy steel having the above composition is advantageous because the composition is simple and it is easy to adjust the chemical components thereof to control the strength.

Next, two-stage continuous heat treatment for yield ratio control is performed, so that the yield ratio of the steel is controlled. Specifically, the material obtained in the previous step is sequentially subjected to first heat treatment, in which the material is heated and maintained for a predetermined period of time at a first temperature ranging from $A_{c1}$ to $A_{c3}$ based on the $A_{c1}$ and $A_{c3}$ transformation temperatures, cooling to a second temperature ranging from Mf to Ms based on a martensite start temperature (Ms) and a martensite finish temperature (Mf), and then second heat treatment, in which the material is maintained at the second temperature for a predetermined period of time, thereby obtaining a steel material having a controlled yield ratio. More preferably, the upper limit of the temperature range for the first heat treatment is $A_{c3}$, and the lower limit of the temperature range for the second heat treatment is (25° C.+Ms)/2.

As such, the first and the second heat treatment may be sufficiently carried out in the time range of 20 min to 1 hr, and thus are more favorable from the aspect of time, compared to the heat treatment time of the conventional processes of FIGS. 1 and 2. In the first and the second heat treatment, a typical heat treatment process using a general continuous heat treatment apparatus is adopted.

In the cooling step, the cooling rate may be adjusted by selecting the appropriate type of cooling from among a variety of known cooling processes, including rapid cooling such as water quenching, slow cooling such as air cooling, etc., depending on the need.

The steel material having a controlled yield ratio, as obtained by the method of manufacturing yield ratio-controlled steel according to the present invention, is Non-Heat-Treated steel for cold forging having a tensile strength of 80 kgf/mm$^2$, and may facilitate the manufacture of various bolts as shown in Table 1, compared to when using conventional materials. Moreover, as the alloy composition and the heat treatment conditions are properly changed, it may be used as Non-Heat-Treated steel for cold forging having a tensile strength of at least 60 to 140 kgf/mm$^2$.

In this regard, the yield ratio-controlled steel manufactured by the method according to the present invention may be additionally subjected to cold forging, thereby obtaining a variety of cold forged parts, such as bolts, shafts, bars, rods, or studs.

After the cold forging process, plating for surface coating treatment to enhance corrosion resistance of a final forged part and then baking may be additionally implemented. The baking process is essentially required after the plating treatment. When hydrogen generated in the plating process is allowed to remain in the product, hydrogen embrittlement may result. In order to prevent the generation of such hydrogen embrittlement, baking is carried out as a dehydrogenation process, whereby strength is enhanced due to Cottrell effects.

EXAMPLE 1

Manufacture of Yield Ratio-Controlled Steel (YRCS80) Through Two-Stage Heat Treatment and of Cold Forged Part (8T Bolt) Using the Same In Example 1, a steel wire, comprising 0.15 wt % C, 1.5 wt % Mn, 1.5 wt % Si, and 0.050 wt % Al, with the remainder of Fe and unavoidable impurities, was sequentially subjected to first heat treatment at 800° C. for 20 min and then second heat treatment at 400 to 430° C. for 30 min, thus obtaining YRCS80 as yield ratio-controlled steel, which was then applied to the manufacture of a 8T bolt. The results thereof were compared with the conventional results.

Figure 4:
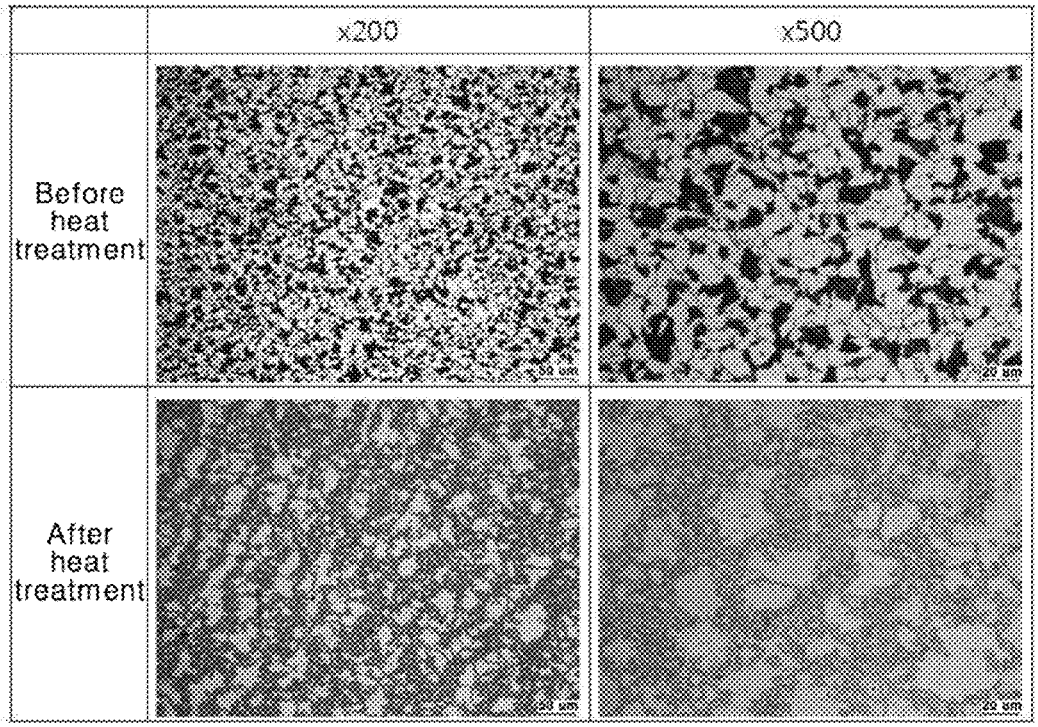
FIG. 4 illustrates microscope images of the structure of the yield ratio-controlled steel YRCS80 of Example 1 before and after two-stage heat treatment.
Figure 5:
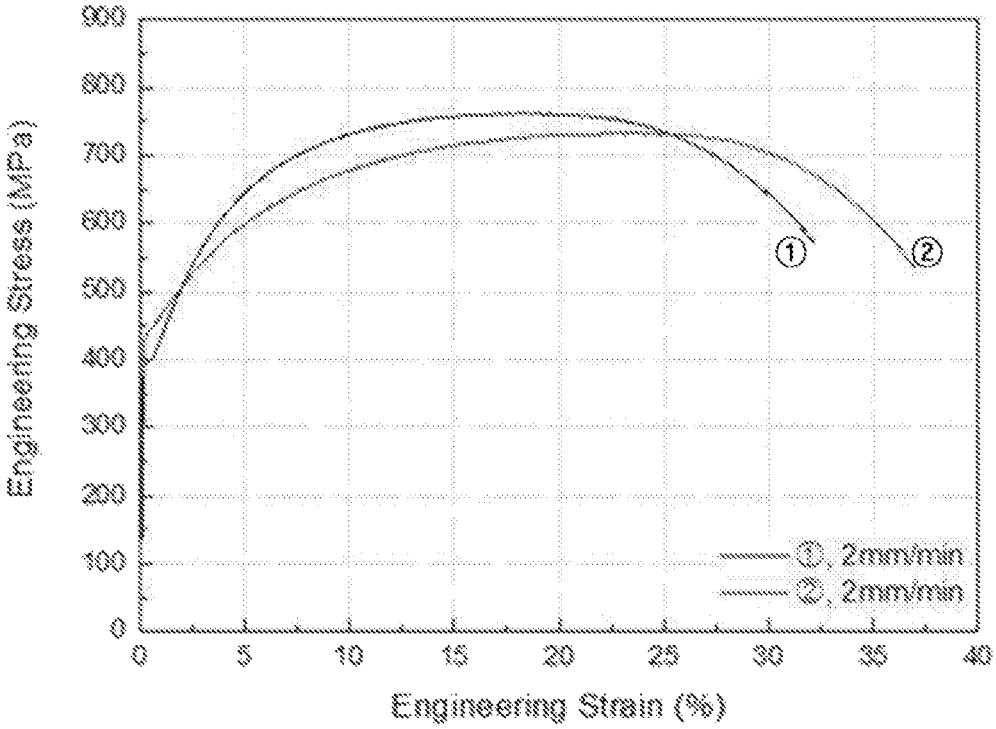
FIG. 5 is a graph illustrating changes in tensile strength of the yield ratio-controlled steel YRCS80 of Example 1 depending on the heat treatment conditions.

FIG. 4 illustrates the microscope images of the structure of the steel before and after two-stage heat treatment according to the present invention, and FIG. 5 illustrates changes in hardness of the steel before and after two-stage heat treatment for yield ratio control, wherein hardness is increased by about 10% after the heat treatment.

As illustrated in FIG. 4, coarse structure grains may become fine through two-stage heat treatment comprising first heat treatment, cooling, and second heat treatment, according to the present invention.

FIG. 5 illustrates changes in tensile strength of the specimens manufactured according to the present invention depending on the heat treatment conditions.

As seen in FIG. 5 showing the tensile curves of two specimens (①) and ②) having controlled yield ratios, the ① and ② specimens represent different yields ratios of 0.516 and 0.600, respectively. Consequently, even when the same alloy materials are used, the yield ratio thereof may vary depending on the conditions of the two-stage heat treatment for yield ratio control.

Figure 6:
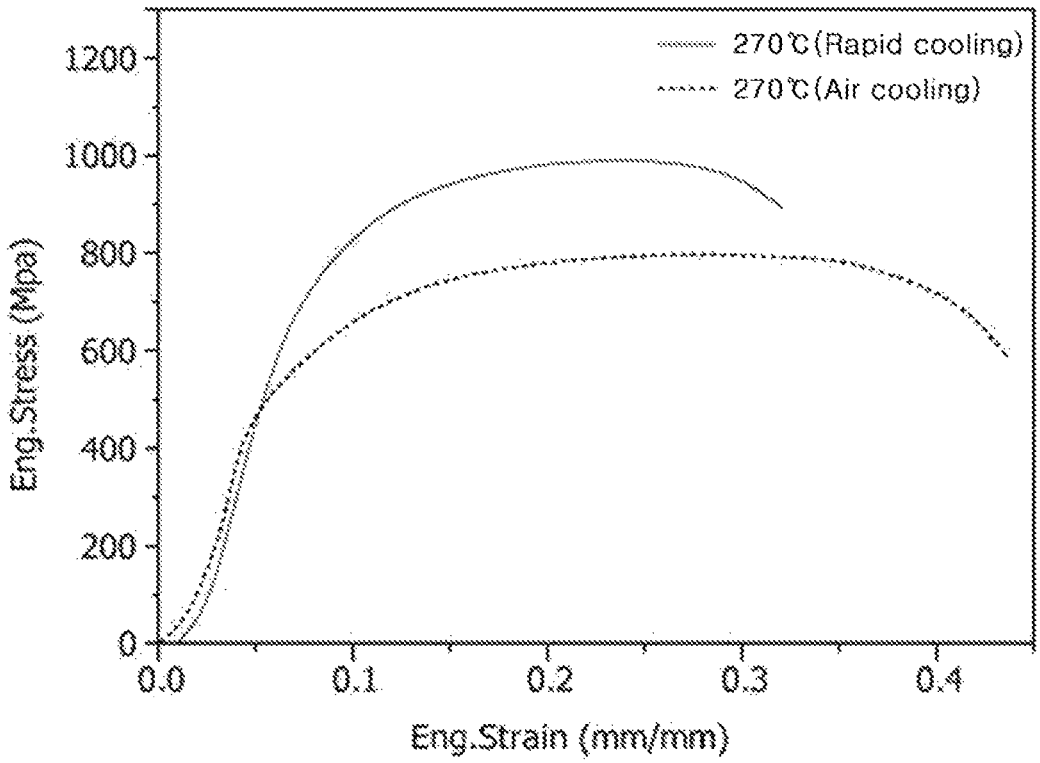
FIG. 6 is a graph illustrating changes in tensile strength of the yield ratio-controlled steel YRCS80 of Example 1 depending on the type of cooling process.

FIG. 6 illustrates changes in tensile strength of the specimens manufactured according to the present invention depending on the type of cooling process.

As illustrated in FIG. 6, in the cooling of the specimens after first heat treatment, the specimen (270° C. (air cooling)) subjected to air cooling to 270° C. exhibits low yield strength and tensile strength, compared to the specimen (270° C. (rapid cooling)) subjected to water quenching to 270° C.

Consequently, even when the same alloy materials are used, the strength and yield ratio thereof may be adjusted depending on the conditions of the cooling process, which is carried out in the course of the two-stage heat treatment for yield ratio control.

Figure 7:
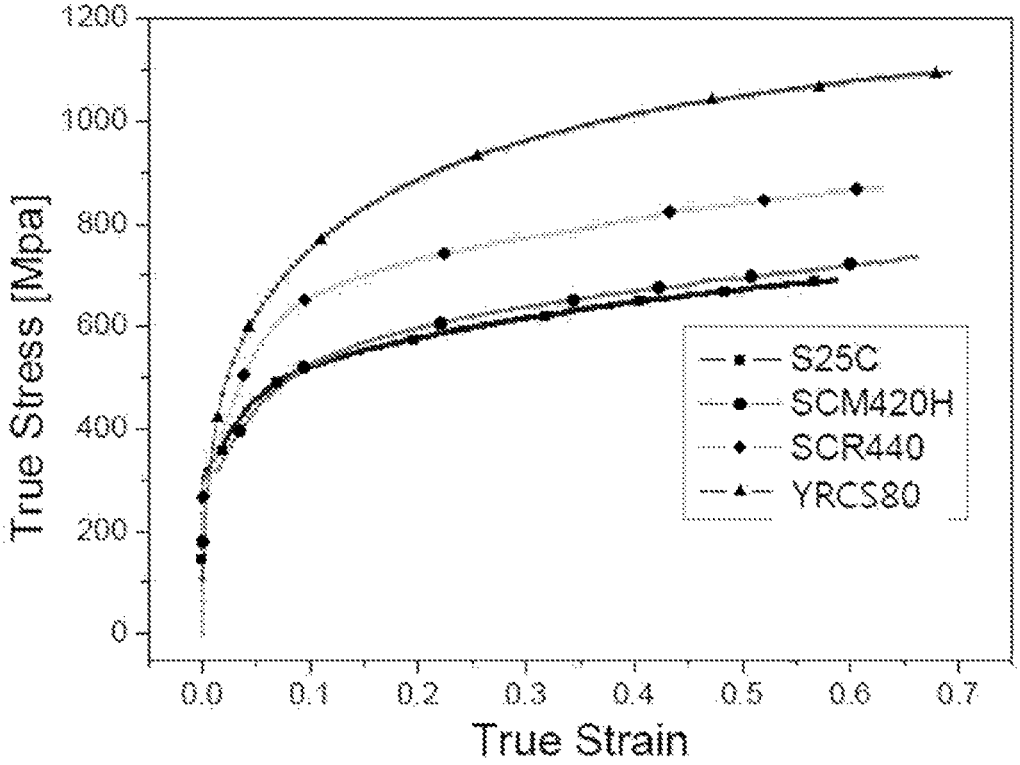
FIG. 7 is a graph illustrating compressive properties of the yield ratio-controlled steel YRCS80 of Example 1.

FIG. 7 illustrates the compressive properties of the inventive specimen and the comparative specimens.

As illustrated in FIG. 7, the YRCS80 specimen subjected to two-stage heat treatment by the manufacturing method according to the present invention exhibits yield strength equal to that of the comparative alloy steel subjected to spheroidizing, but shows strength properties superior to those of the comparative materials subjected to Q/T.

Therefore, the inventive specimen may be utilized as a Non-Heat-Treated material for cold forging because of the high work hardenability thereof.

Figure 8:
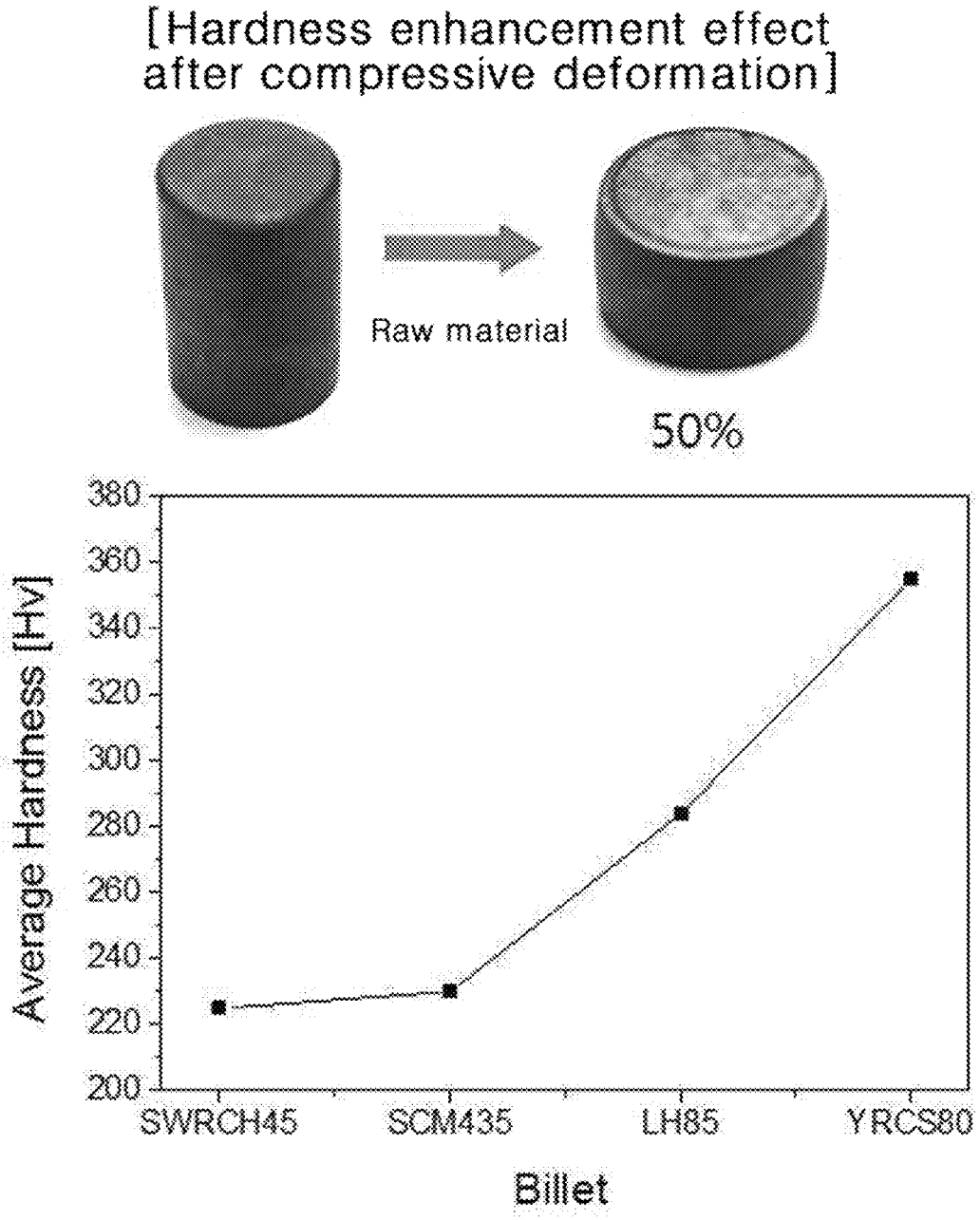
FIG. 8 illustrates the results of measurement of hardness of the yield ratio-controlled steel YRCS80 of Example 1 and the comparative specimens after compressive deformation.

FIG. 8 illustrates the results of measurement of hardness of the inventive specimen and the comparative specimens after compressive deformation.

Based on the results of measurement of changes in hardness of individual materials after compression molding of raw materials to 50%, as illustrated in FIG. 8, the hardness of the inventive material can be increased by a maximum of 50% compared to the other materials (quenched and tempered steel and conventional Non-Heat-Treated steel).

The steel material according to the present invention can be confirmed to manifest remarkably enhanced hardness and strength by virtue of plastic deformation (cold forging), compared to conventional materials.

Figure 9:
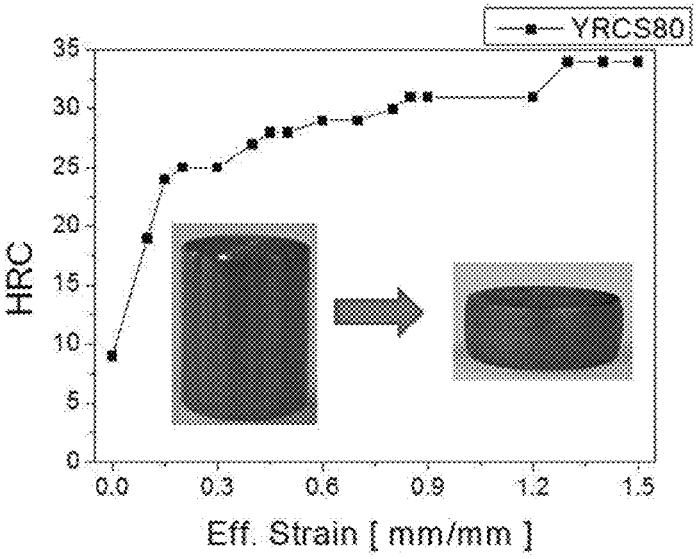
FIG. 9 is a graph illustrating changes in hardness of the yield ratio controlled-steel YRCS80 of Example 1 depending on the compressive strain.

FIG. 9 illustrates changes in hardness of the yield ratio-controlled steel according to the present invention depending on the strain upon compressive deformation, in which the hardness is significantly increased even by a small increase in strain, as in the tensile curve of FIG. 8.

Figure 10A:
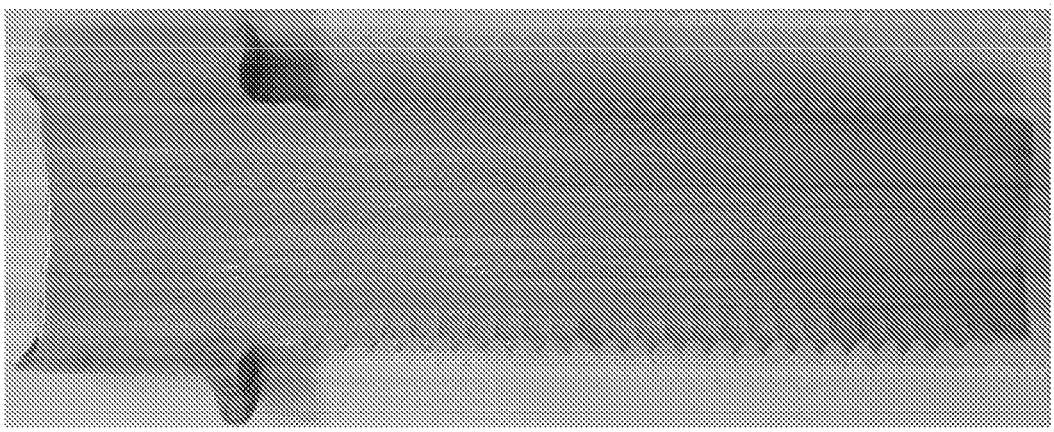
FIGS. 10A to 10C are cross-sectional photographs illustrating the metal flows of the bolts including the 8T bolt of Example 1.
Figure 10B:
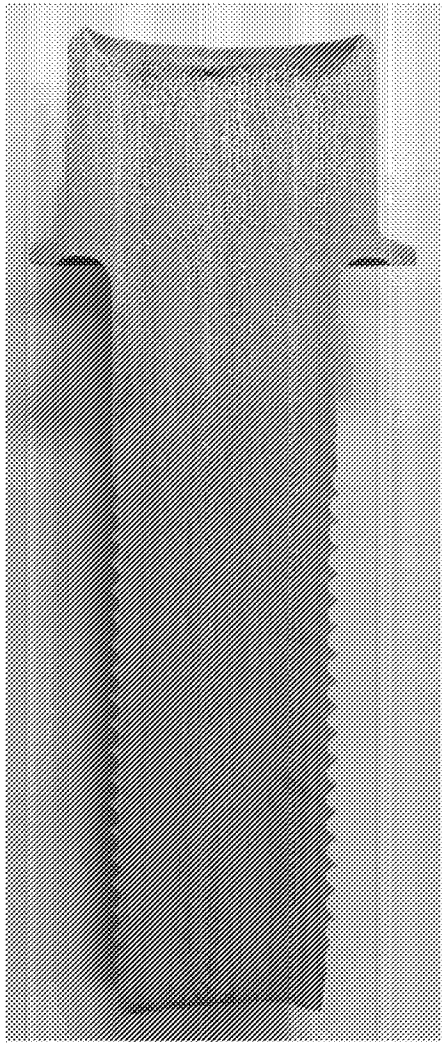
Figure 10C:
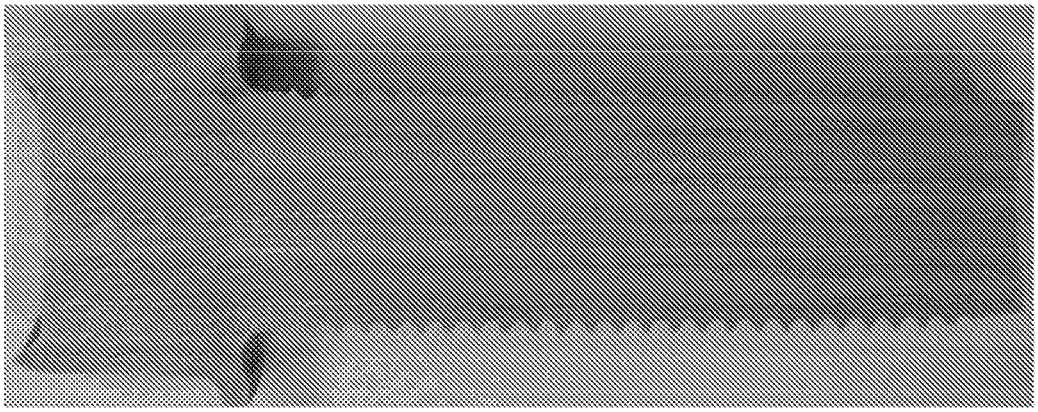

FIGS. 10A to 10C illustrate the metal flows of the bolts including the 8T bolt according to the present invention.

As illustrated in FIGS. 10A to 10C, all of the metal flows of the bolt (FIG. 10A) resulting from spheroidizing and then cold heading of carbon (C) steel 1045K, the bolt (FIG. 10B) resulting from post heat treatment (Q/T) of the forged bolt, and the bolt (FIG. 10C) resulting from cold heading of the 8T material (YRCS80) subjected to two-stage heat treatment according to the present invention are efficient and show the same pattern. In particular, the YRCS80 material can be seen to possess the greatest flowability by the flow line.

Figure 11A:
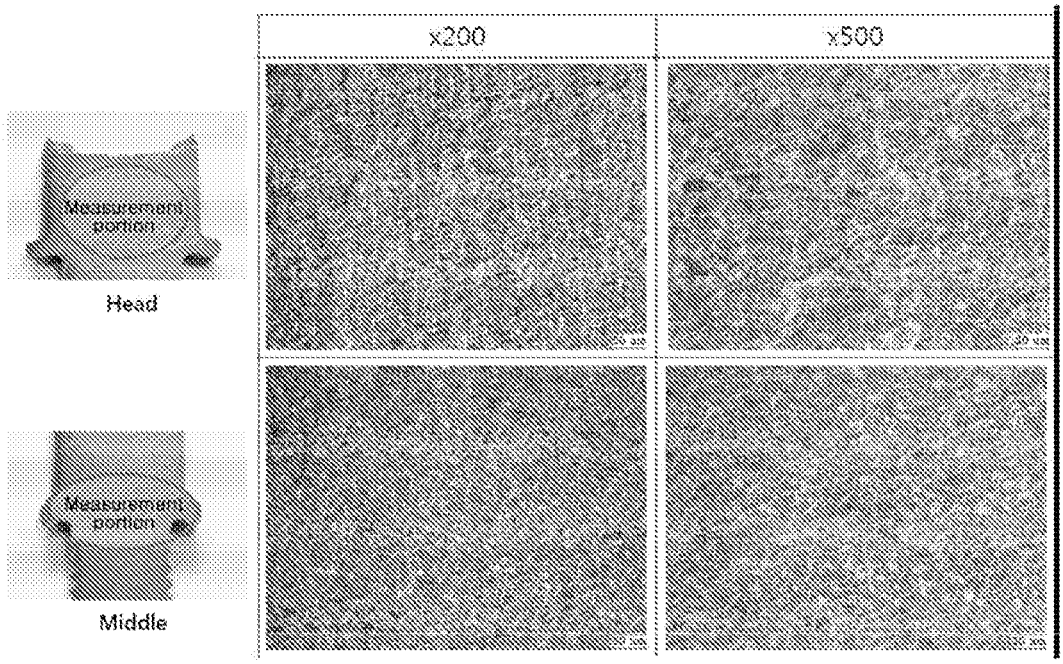
FIGS. 11A to 11C are optical microscope (OM) images illustrating the microstructures of the bolts including the 8T bolt of Example 1.
Figure 11B:
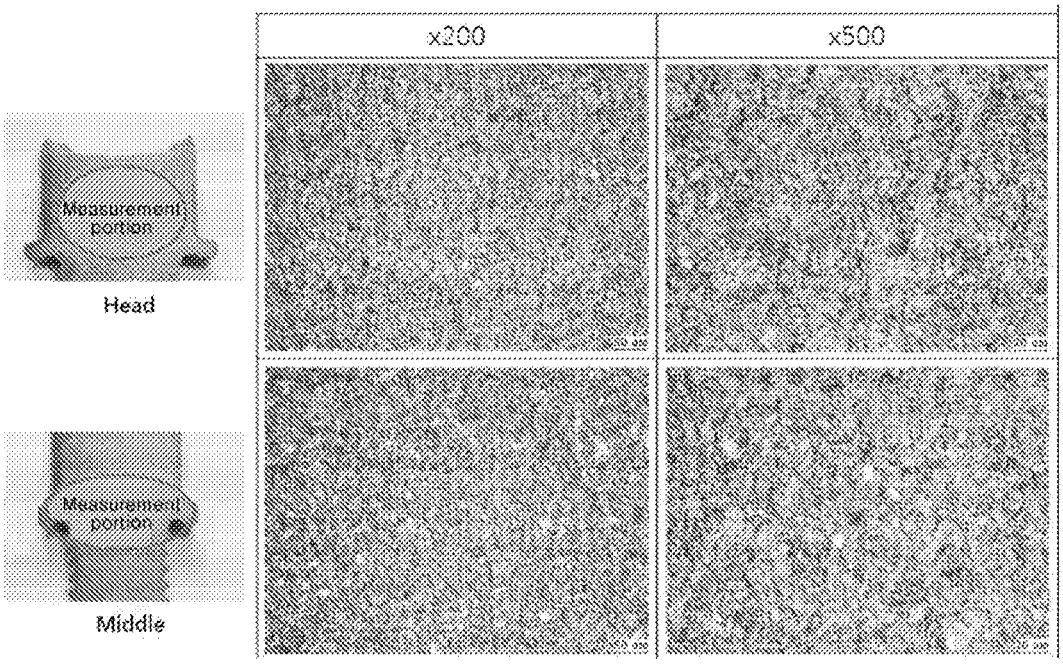
Figure 11C:
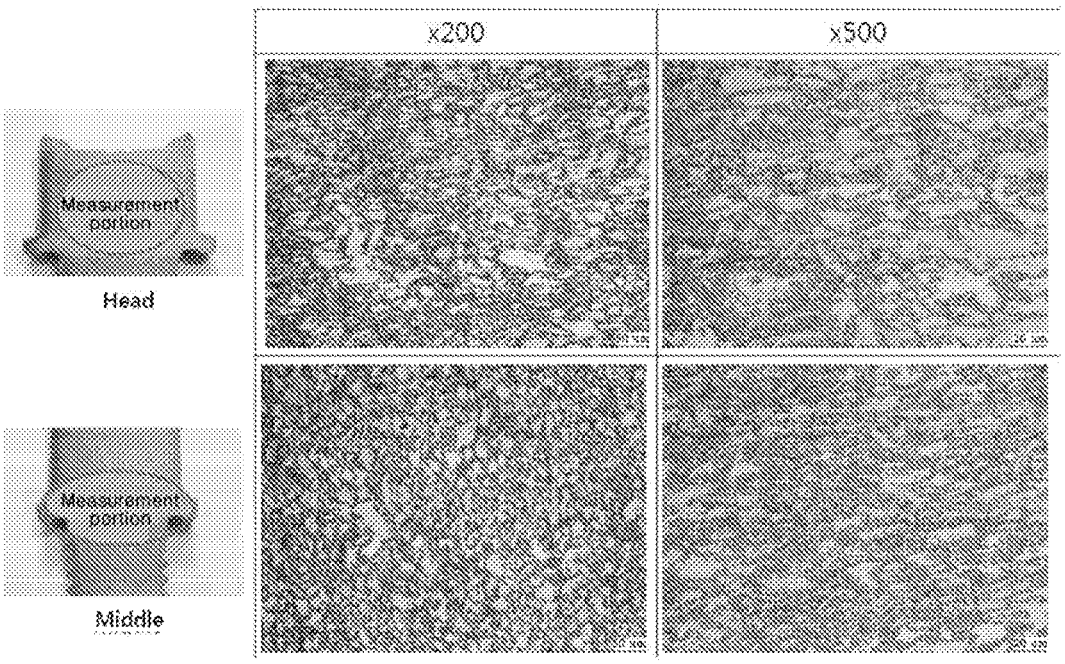

FIGS. 11A to 11C illustrate the optical microscope images of the structures including the structure according to the present invention.

As illustrated in FIGS. 11A to 11C, the bolt structure (FIG. 11A) subjected to cold heading exhibits the compressed spheroidized cementite structure, and the structure (FIG. 11B), subjected to cold heading and then Q/T, exhibits the tempered martensite structure. Meanwhile, the structure of the 8T bolt (FIG. 11C) subjected to two-stage heat treatment according to the present invention shows that the network structure (FIG. 4) after two-stage heat treatment according to the present invention is compressed by cold heading.

When the two-stage heat treatment according to the present invention is performed in this way, the structure becomes fine, and high work hardenability can be expected.

Figure 12:
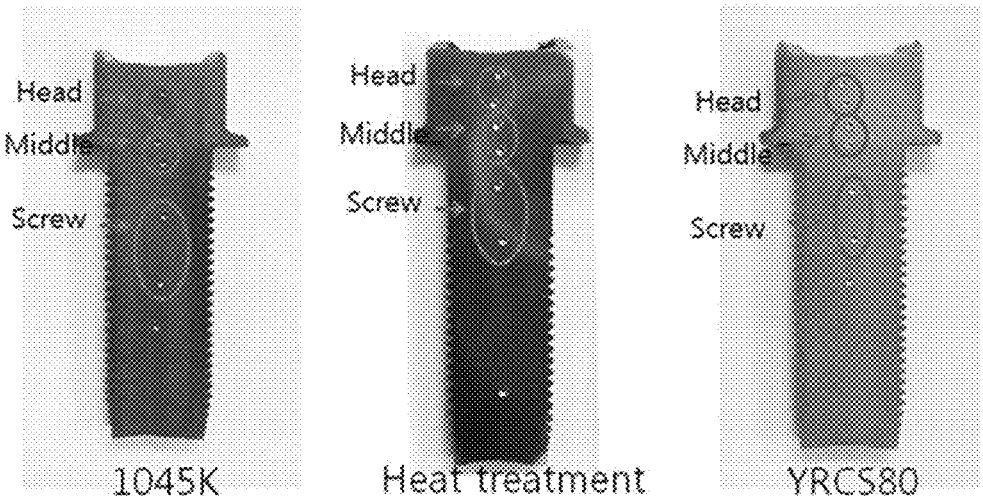
FIG. 12 illustrates the hardness results of the 8T bolt of Example 1 and the conventional bolts made of typical quenched and tempered steel.

FIG. 12 illustrates the hardness of the bolts including the 8T bolt according to the present invention.

As illustrated in FIG. 12, the forged bolt (1045K) exhibits a hardness of HRC (Hardness of Rockwell) 14 to 23 at the measurement portions thereof before Q/T, and shows a hardness of HRC 25 or higher, meeting the required hardness (HRC 25 to 29) at the measurement portions thereof after Q/T. Meanwhile, the bolt (YRSC80) manufactured according to the present invention manifests required hardness (HRC 25 or higher) at all the measurement portions thereof after the forging. Consequently, the same properties as in the conventional quenched and tempered material can be obtained using only the forging process, without Q/T, in the present invention.

EXAMPLE 2

Manufacture of Yield Ratio-Controlled Steel (YRCS100) Through Two-Stage Heat Treatment and of Cold Forged Part (10T Bolt) Using the Same In Example 2, a steel wire, comprising 0.22 wt % C, 1.5 wt % Mn, 1.5 wt % Si, and 0.050 wt % Al, with the remainder of Fe and unavoidable impurities, was sequentially subjected to first heat treatment at 800° C. for 35 min, water quenching, and then second heat treatment at 270° C. for 30 min, thus obtaining YRCS100 as yield ratio-controlled steel, which was then applied to manufacture a 10T bolt. The results thereof were compared with the conventional results.

Figure 13:
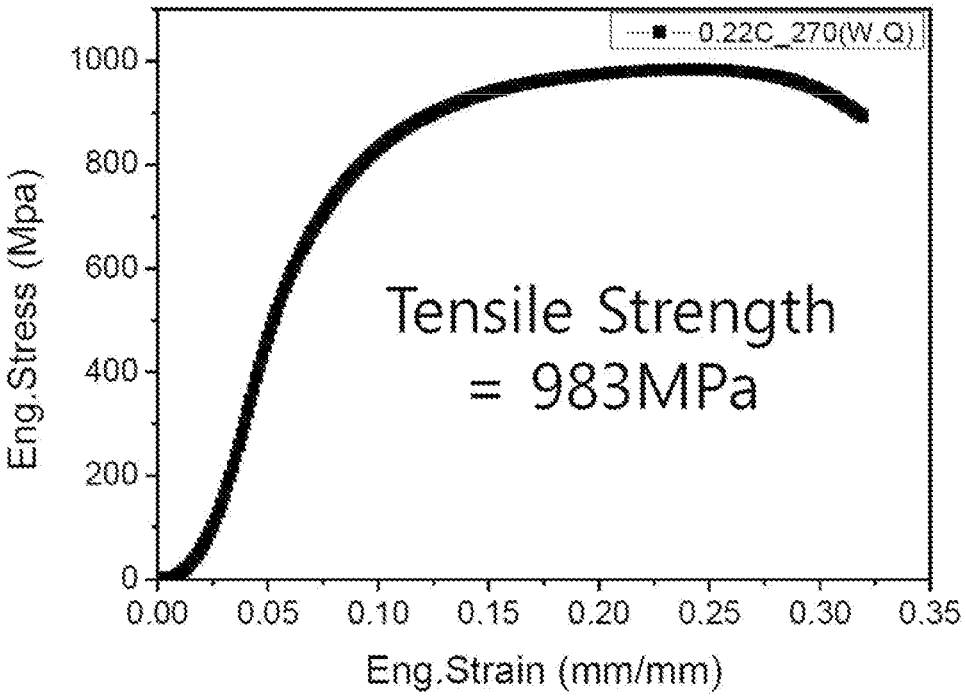
FIG. 13 is a graph illustrating the stress-strain of the yield ratio-controlled steel YRCS100 of Example 2.

FIG. 13 is a graph illustrating the stress-strain of the yield ratio-controlled steel YRCS100 of Example 2. As illustrated in FIG. 13, the YRCS100 specimen having a tensile strength of 983 MPa can be confirmed to be usable as a 10T grade high-tension bolt material.

Figure 14:
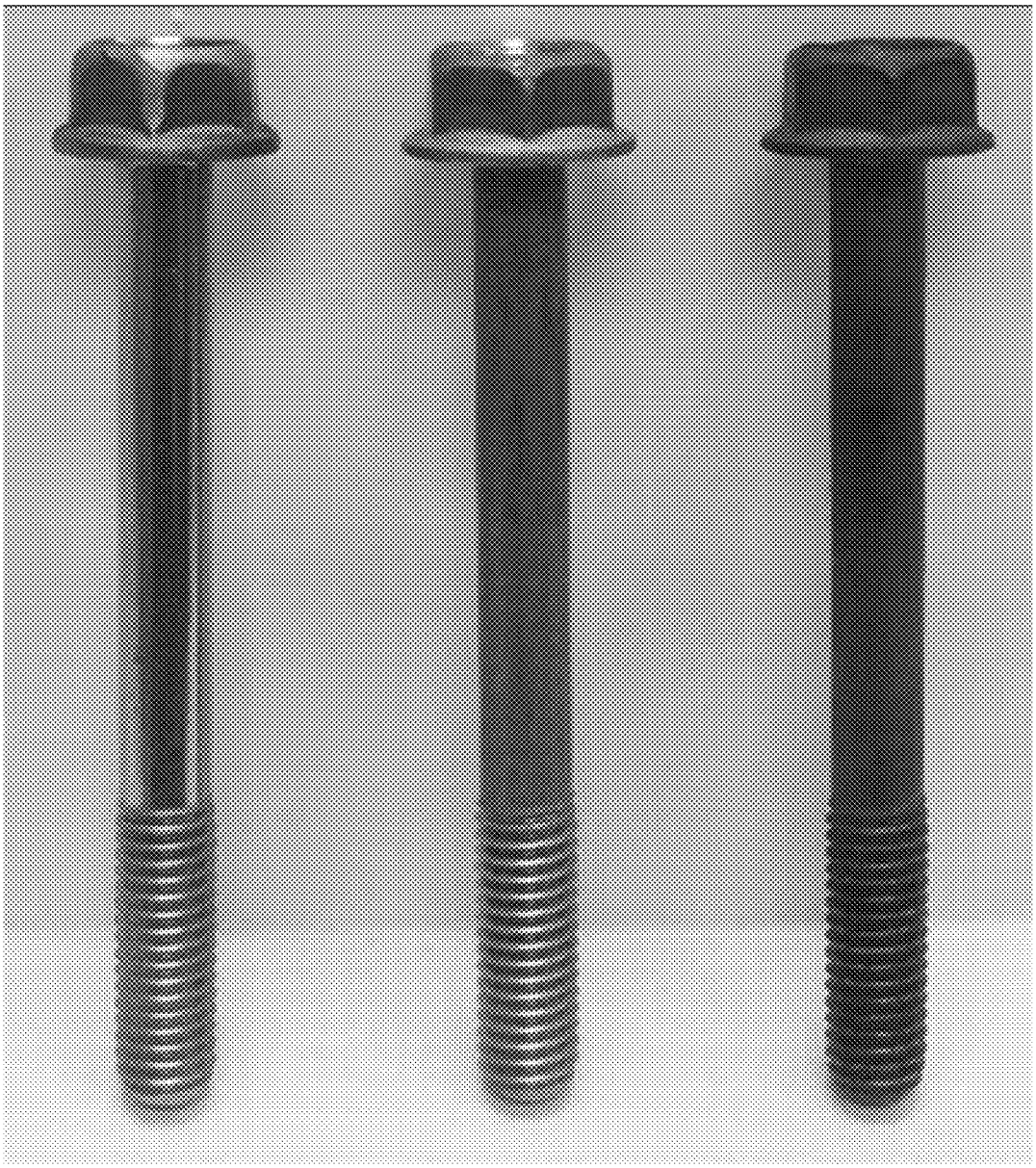
FIG. 14 illustrates the outer appearances of the 10T bolt of Example 2 and conventional bolts made of typical quenched and tempered steel.

FIG. 14 illustrates the outer appearances of the bolt (YRCS100 [Forging]) resulting from cold heading of the 10T material (YRCS100) subjected to two-stage heat treatment of Example 2, the bolt (SCM435 [Forging]) resulting from spheroidizing and then cold heading of SCM435 as a Cr—Mo steel material for 12.9 grade bolts, and the bolt (SCM435 [Forging and Q/T]) resulting from post heat treatment (Q/T) of the above bolt (SCM435 [Forging]).

Figure 15:
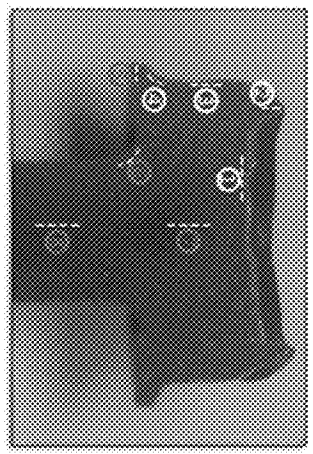
FIG. 15 illustrates the hardness results of the 10T bolt of Example 2 and the conventional bolts made of typical quenched and tempered steel.

FIG. 15 illustrates the results of measurement of hardness of the bolts at different positions.

As illustrated in FIG. 15, the forged bolt (SCM435 [Forging]) exhibits a hardness of about HRC 21 to 30 at the measurement portions thereof before Q/T, and the bolt (SCM435 [Forging and Q/T]) manifests a hardness of HRC 34 to 35 at the measurement portions thereof after Q/T. On the other hand, the 10T bolt (YRCS100 [Forging]) according to the present invention possesses improved hardness at all of the measurement portions, compared to commercially available 10T bolts subjected to Q/T, and exhibits a hardness of HRC 35 to 37 at the measurement portions.

Therefore, even when only forging is performed without post heat treatment in the present invention, 10T grade high-tension bolts having high quality can be manufactured compared to when using conventional quenched and tempered materials.

EXAMPLE 3

Manufacture of Yield Ratio-Controlled Steel (YRCS110) Through Two-Stage Heat Treatment In Example 3, a steel wire, comprising 0.30 wt % C, 1.5 wt % Mn, 1.5 wt % Si, and 0.050 wt % Al, with the remainder of Fe and unavoidable impurities, was sequentially subjected to first heat treatment at 800° C. for 35 min, water quenching, and then second heat treatment at 270° C. for 30 min, thus obtaining YRCS110 as yield ratio-controlled steel.

Figure 16:
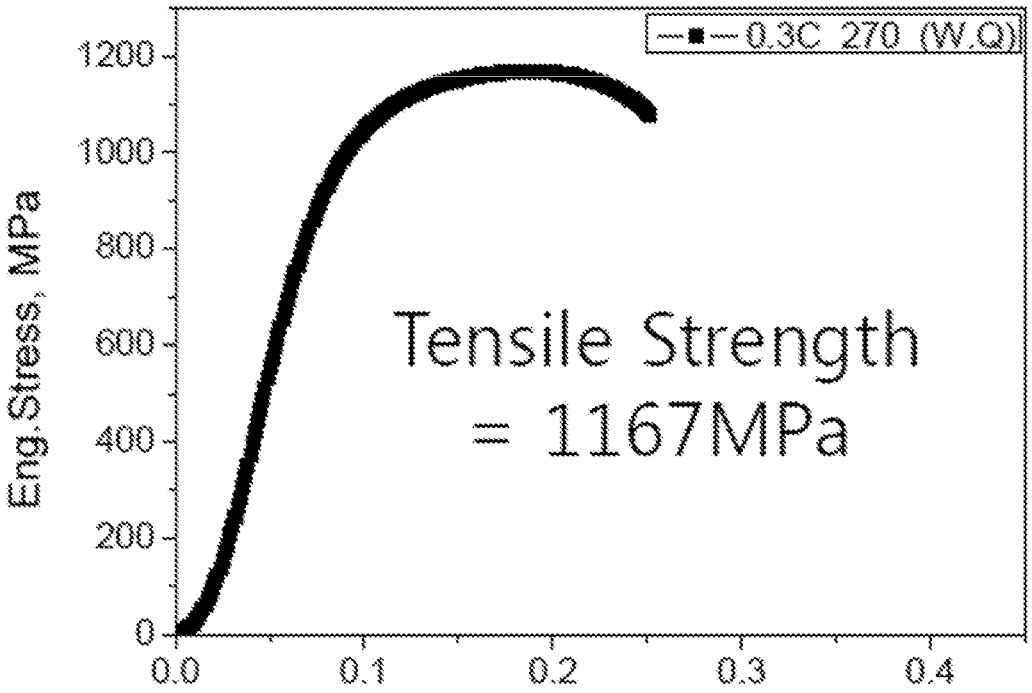
FIG. 16 is a graph illustrating the stress-strain of the yield ratio-controlled steel YRCS110 of Example 3.

FIG. 16 is a graph illustrating the stress-strain of the yield ratio-controlled steel YRCS110 of Example 3. As illustrated in FIG. 16, the YRCS110 specimen has a tensile strength of 1167 MPa and can thus be used as an 11T grade high-tension bolt material.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a yield ratio-controlled steel, comprising the steps of :

subjecting an alloy of steel, comprising 0.10 to 0.40 wt % carbon (C), 0.90 to 1.50 wt % manganese (Mn), 0.50 to 2.50 wt % silicon (Si), and 0.060 wt % or less but exceeding 0 wt % aluminum (Al), with a remainder of iron (Fe) and unavoidable impurities, to rolling or wire drawing, thus obtaining a material;

performing a first heat treatment on the material, in which the material is heated to and maintained for a first predetermined period of time at a first temperature ranging from $A_{c1}$ to $A_{c3}$, which are $A_{c1}$ and $A_{c3}$ transformation temperatures; and immediately after the end of the first predetermine period of time, cooling the material to a second temperature ranging from (25° C+Ms)/2 to Ms, where Ms is a martensite start temperature;

performing a second heat treatment immediately after the material is cooled to the second temperature, in which the material is maintained at the second temperature for a second predetermined period of time; and generating in the material bainite or martensite based on ferrite.

2. The method of claim 1, wherein the cooling step is performed by air cooling or water quenching.

3. The method of claim 1, wherein the yield ratio-controlled steel is a Non-Heat-Treated steel for cold forging with a tensile strength of at least 60 to 140 kgf/mm$^2$.

4. The method of claim 1, wherein the yield ratio-controlled steel is a Non-Heat-Treated steel for cold forging with a tensile strength of 80 kgf/mm$^2$, and comprises 0.15 wt % C, 1.5 wt % Mn, 1.5 wt % Si, and 0.050 wt % Al, with the remainder of Fe and unavoidable impurities.

5. The method of claim 1, wherein the yield ratio-controlled steel is a Non-Heat-Treated steel for cold forging with a tensile strength of 100 kgf/mm$^2$, and comprises 0.22 wt % C, 1.5 wt % Mn, 1.5 wt % Si, and 0.050 wt % Al, with the remainder of Fe and unavoidable impurities.

6. The method of claim 1, wherein the yield ratio-controlled steel is a Non-Heat-Treated steel for cold forging with a tensile strength of 110 kgf/mm$^2$, and comprises 0.30 wt % C, 1.5 wt % Mn, 1.5 wt % Si, and 0.050 wt % Al, with the remainder of Fe and unavoidable impurities.

7. A yield ratio-controlled steel, manufactured by the method of claim 1.

8. The yield ratio-controlled steel of claim 7, which has a ferrite-based network structure.

9. A method of manufacturing a cold forged part, comprising the steps of:

subjecting an alloy of steel, comprising 0.10 to 0.40 wt % carbon (C), 0.90 to 1.50 wt % manganese (Mn), 0.50 to 2.50 wt % silicon (Si), and 0.060 wt % or less but exceeding 0 wt % aluminum (Al), with a remainder of iron (Fe) and unavoidable impurities, to rolling or wire drawing, thus obtaining a material;

performing first a heat treatment on the material, in which the material is heated to and maintained, for a first predetermined period of time, at a first temperature ranging from $A_{c1}$ to $A_{c3}$, which are $A_{c1}$ and $A_{c3}$ transformation temperatures;

immediately after the end of the first predetermine period of time, cooling the material to a second temperature ranging from (25° C+Ms)/2 to Ms, wherein Ms is a martensite start temperature;

performing a second heat treatment immediately after the material is cooled to the second temperature, in which the material is maintained at the second temperature for a second predetermined period of time;

generating in the material bainite or martensite based on ferrite and subjecting the material to cold forging.

10. A cold forged part, manufactured by the method of claim 9.

11. The cold forged part of claim 10, wherein the cold forged part is a bolt, a shaft, a bar, a rod, or a stud.

* * * * *